US007814669B2

(12) United States Patent
Kingsbury

(10) Patent No.: US 7,814,669 B2
(45) Date of Patent: Oct. 19, 2010

(54) MULTI-SPOT ADJUSTABLE REFLEX BOW SIGHT

(76) Inventor: Klint M. Kingsbury, 54 Rainey St., No. 304, Austin, TX (US) 78701

( * ) Notice: Subject to any disclaimer, the term of this patent is extended or adjusted under 35 U.S.C. 154(b) by 13 days.

(21) Appl. No.: 12/214,556

(22) Filed: Jun. 18, 2008

(65) Prior Publication Data

US 2009/0139100 A1 Jun. 4, 2009

Related U.S. Application Data

(60) Provisional application No. 60/936,121, filed on Jun. 18, 2007.

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | |
|---|---|---|---|---|
| 5,090,805 | A | 2/1992 | Stawarz | |
| 5,231,765 | A | 8/1993 | Sherman | |
| 5,351,671 | A | 10/1994 | Cervera | |
| 5,383,278 | A | 1/1995 | Kay | |
| 5,394,615 | A | 3/1995 | Hoppe et al. | |
| 5,456,035 | A | 10/1995 | Stiles | |
| 5,619,801 | A | 4/1997 | Slates | |
| 5,634,278 | A | 6/1997 | London | |
| 5,653,034 | A | 8/1997 | Bindon | |
| 5,685,081 | A * | 11/1997 | Winegar | 33/265 |
| 5,813,159 | A | 9/1998 | Kay et al. | |
| 5,914,775 | A | 6/1999 | Hargrove et al. | |
| 6,634,110 | B2 * | 10/2003 | Johnson | 33/265 |
| 6,725,854 | B1 | 4/2004 | Afshari | |
| 7,082,690 | B1 * | 8/2006 | Khoshnood | 33/265 |
| 7,086,161 | B2 * | 8/2006 | Ellig et al. | 33/265 |
| 7,574,810 | B1 * | 8/2009 | LoRocco | 33/265 |
| 2001/0032393 | A1 * | 10/2001 | Springer | 33/265 |
| 2005/0150119 | A1 * | 7/2005 | Ellig et al. | 33/265 |
| 2006/0150429 | A1 | 7/2006 | Khoshnood | |
| 2006/0156561 | A1 * | 7/2006 | Afshari | 33/265 |

(Continued)

OTHER PUBLICATIONS

Summit Stands (Apr. 2007) www.summitstands.com/NR/rdonlyyes/4C43F46F-8513-4195-88CA-CEEEF57FA62C/0/bowsitecatalog2_3.pdf.

*Primary Examiner*—Christopher W Fulton
(74) *Attorney, Agent, or Firm*—Kammer Browning PLLC

(57) ABSTRACT

A bow sight that utilizes fiber optic wave guides as a basis for collecting ambient light and providing multiple sighting spots within the archer's field of view. The terminal ends of the fiber optic wave guides are positioned so as to have images thereof reflected on a moveable reflective plane (objective optic) within the bow sight. The multiple aiming spots thus reflected in the bow sight provide the archer with sighting spots for targets over a range of distances. Each of the individual fiber optic wave guides collects ambient light and terminates in a terminal block that may be varied in its position so as to individually adjust the reflected image of the aiming spot. Various mechanisms within the fiber optic terminal block for adjusting the position of the ambient light wave guide are also described. The bow sight provides the advantages of multi-spot ambient light fiber optic systems with the advantages of reflective (reflex) sighting systems.

1 Claim, 20 Drawing Sheets

U.S. PATENT DOCUMENTS

2006/0254065 A1 11/2006 Grace
2007/0028467 A1 2/2007 Bradley et al.
2007/0068018 A1 3/2007 Gilmore
2009/0000134 A1* 1/2009 Kurtzhals et al. ..... 33/265

* cited by examiner

MULTI-SPOT ADJUSTABLE REFLEX BOW SIGHT

CROSS REFERENCE TO RELATED APPLICATIONS

This application claims the benefit under Title 35 United States Code §119(e) of U.S. Provisional Application No. 60/936,121; Filed: Jun. 18, 2007, the full disclosure of which is incorporated herein by reference.

BACKGROUND OF THE INVENTION

1. Field of the Invention

The present invention relates generally to sighting mechanisms for use in conjunction with archery bows. The present invention relates more specifically to bow sights that use illuminated spots to facilitate the aiming of an archery bow at targets over a variety of distances.

2. Background of the Invention

A number of devices have been developed to facilitate the aiming of an archery bow at a target positioned over a range of distances from the archer. The nature of archery is such that relatively small variations in distance to a target require relatively significant variations in the angle at which the archer holds the bow and aims towards the target. Whereas a distance difference of one hundred yards may merit little change in the aiming angle for a rifle, such distance variations in archery required a much more significant change in the aiming angle. Sighting devices designed for rifles do not translate well into sights suitable for bows.

Many sighting devices for archery have been developed in recent years that utilize light image aiming spots that are positioned within the archer's field of view. In general, such sights either provide a direct view of one end of a fiber optic light guide or provide a reflected image of an LED or other light source. The view produced in either case is typically positioned within a ring that forms the bow sight through which the archer aims. Fiber optic light wave guides are typically positioned within the field of view and extend to one side where they are arranged so as to either gather light from ambient sources or to connect to a small electrically powered light source such as an LED. Such designs provide the ability to individually adjust the position of each of the spots thus created within the bow sight.

Other efforts in the past have focused on providing electrical light sources either directly in the bow sight (in place of the fiber optic light wave guides) or positioning electrical light sources in such a manner that a reflection of the light source is directed towards the archer through the bow sight. What has not been achieved in the prior art is a bow sight that combines the advantages of a fiber optic based system utilizing ambient light with the advantages of a reflective bow sight system that eliminates the need to directly position light sources or light guides within the field of view. The present invention provides such a solution to the problem of an efficient, adjustable, and inexpensive bow sight.

Other efforts in the past have included the following patents and patent applications:

U.S. Pat. No. 5,090,805 issued to Stawarz on Feb. 25, 1992 entitled Bow Sight with Projected Reticule Aiming Spot.

U.S. Pat. No. 5,383,278 issued to Kay on Jan. 24, 1995 entitled Wide Field of View Reflex Sight for a Bow.

U.S. Pat. No. 5,653,034 issued to Bindon on Aug. 5, 1997 entitled Reflex Sighting Device for Day and Night Sighting.

U.S. Pat. No. 5,231,765 issued to Sherman on Aug. 3, 1993 entitled Illuminated Sight Having a Light Collector Serving a Fiber Optic.

U.S. Pat. No. 5,394,615 issued to Hoppe et al. on Mar. 7, 1995 entitled Light Archery Sight.

U.S. Pat. No. 5,634,278 issued to London on Jun. 3, 1997 entitled Bow Sight.

U.S. Pat. No. 5,813,159 issued to Kay et al. on Sep. 29, 1998 entitled Wide Field of View Reflex Gunsight.

U.S. Pat. No. 5,914,775 issued to Hargrove et al. on Jun. 22, 1999 entitled Triangulation Rangefinder and Sight Positioning System.

U.S. Pat. No. 6,725,854 issued to Afshari on Apr. 27, 2004 entitled Illuminated Sight Pin.

U.S. Patent Application Publication No. US 2006/0254065 A1 (Grace) published on Nov. 16, 2006 entitled Archery Bow Sight.

U.S. Pat. No. 5,619,801 issued to Slates on Apr. 15, 1997 entitled Fiber Optic Pin Sight for a Bow.

U.S. Patent Application Publication No. US 2006/0150429 A1 (Khoshnood) published on Jul. 13, 2006 entitled Ambient Light Collecting Sight Pin for a Bow Sight.

The full disclosures of each of the issued U.S. Patents and the Published Applications listed above are incorporated in their entirety herein by reference.

SUMMARY OF THE INVENTION

The present invention provides a bow sight that utilizes fiber optic wave guides as a basis for collecting ambient light and projecting multiple aiming spots within the archer's field of view. Rather than positioning the terminal end of the fiber optic wave guides directly in the field of view (as well as the required support structures), the wave guide terminal ends are positioned so as to have images thereof reflected on a moveable reflective objective optic within the archer's field of view. The multiple aiming spots thus reflected in the bow sight provide the archer with sighting spots for targets over a range of distances.

Each of the individual fiber optic wave guides collects ambient light and terminates in a terminal block that may be varied in its position so as to individually adjust the reflected image of the aiming spot. Various mechanisms for adjusting the position of the ambient light wave guides are also described.

The various figures include referenced elements and components that are common and which include the following referenced component:

| | |
|---|---|
| 10 | bow stock cross section (dashed outline) |
| 12 | bow mounting plate |
| 14 | clamp screw (horizontal adjustment) |
| 16 | clamp (vertical) |
| 18 | clamp screw (vertical adjustment) |
| 20 | sight stock |
| 22 | projection stock |
| 24 | fiber optic channel |
| 26 | channel cover plate |
| 28a-28d | fiber optic terminal blocks (four spot version) |

-continued

| | |
|---|---|
| 30a-30d | fiber optic adjustment set screws (four spot version) |
| 32a-32d | fiber optic wave guides (four spot version) |
| 34 | light receptor coil assembly |
| 36 | coil bracket |
| 38 | sight base assembly |
| 40 | sight tube (sight ring) |
| 42 | reflective objective optic |
| 44 | optic retainer ring |
| 46 | sight pivot screw |
| 48 | sight adjustment screw |
| 50a-50d | aiming spot images |
| 52 | bow stock mounting apertures |
| 60 | alternate embodiment bow sight system |
| 62 | bow mounting plate |
| 64 | vertical adjustment clamp |
| 66 | lens bracket |
| 68 | sight tube with optic |
| 70 | main beam |
| 72 | fiber optic holder rack |
| 74 | right fiber optic holder shell |
| 76 | left fiber optic holder shell |
| 80 | fiber optic holder (typical) |
| 82 | mounting holes |
| 84 | fiber light gathering slots |
| 86 | fiber optic adjustment view window |
| 88 | mounting plate clamp tightening screw |
| 90 | sight tube mounting screw |
| 92 | horizontal fiber optic image adjustment screw |
| 94 | vertical adjustment clamp tightening screw |
| 96 | sight tube mounting screws |
| 98 | fiber optic passage |
| 100 | fiber optic holder adjustment screw |
| 102 | fiber optic channel aperture |

DETAILED DESCRIPTION OF THE PREFERRED EMBODIMENTS

Figure 1:
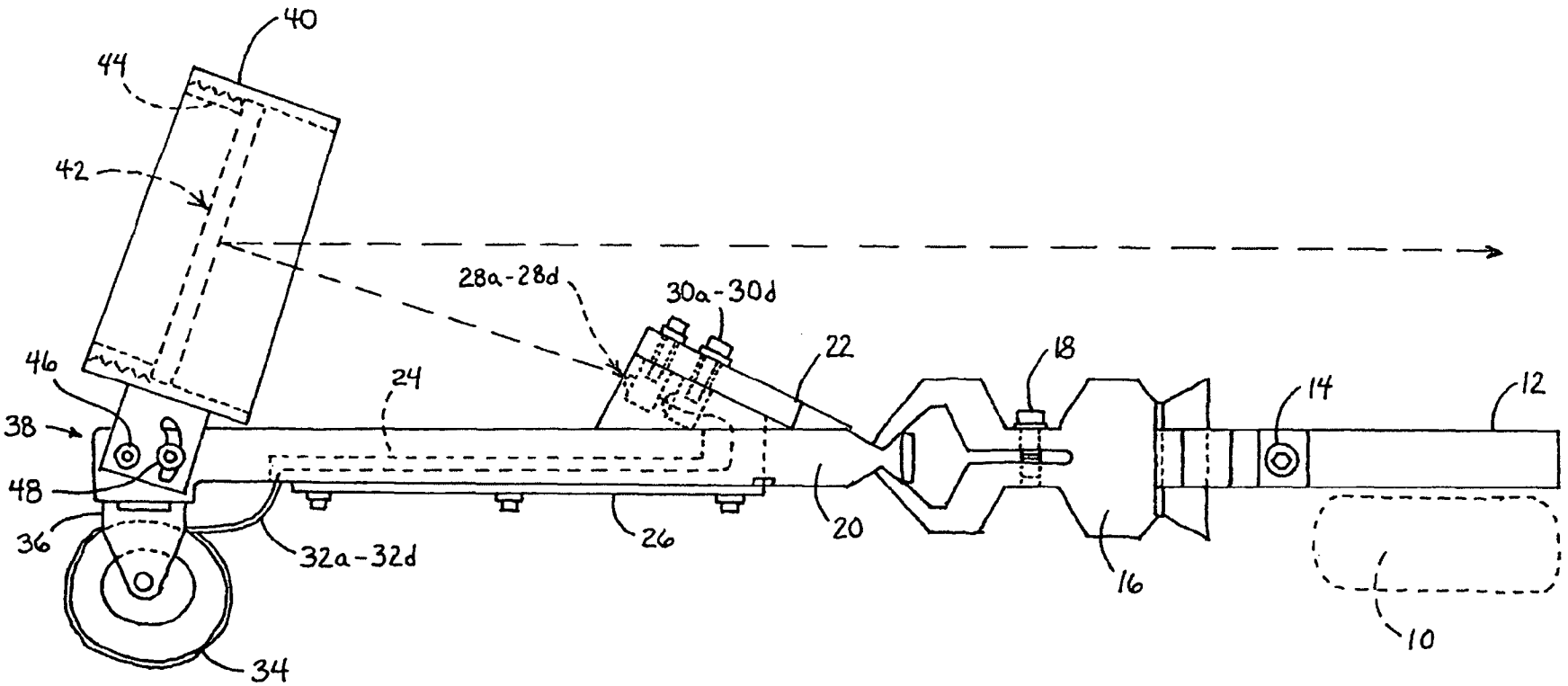
FIG. 1 is a top plan view of a first embodiment of the complete bow sight system of the present invention.

The present invention is generally described by the referenced Drawing figures attached. FIG. 1 discloses the manner in which the assembly of the invention is attached to a bow stock and provides a first preferred embodiment of the invention. In general the invention comprises an assembly of components that provide multiple adjustable aiming spots within the field of view of the archer. The ambient light for the aiming spots is gathered in an assembly of fiber optic coils held on a bracket to one side of the bow sight. The light is carried by the fiber optic wave guides along the bracket frame of the bow sight to a fiber optic terminal block adjustment assembly. The light is then projected onto an angled partially reflective objective optic where it is reflected into the archer's field of view. The multiple aiming spots are positioned vertically one above the other and allow the archer to place an aiming spot on the target according to an estimate range to the target. That is, a target that is close might require use of the highest aiming spot (lowering the angle of the bow) in the field of view while a very distant target might require use of the lowest aiming spot (lifting the angle of the bow).

The side to side placement of the aiming spots in the field of view is achieved by way of a pivoting sight tube bracket. The elevation (vertical adjustment) of the individual aiming spots may be varied according to one of a number of different mechanisms within the fiber optic terminal block assembly as disclosed in the attached Drawing figures. Four (4) spot and five (5) spot versions of the preferred embodiments are shown although those skilled in the art will recognize that the present invention lends itself to use in conjunction with systems that incorporate from three (3) to as many as seven (7) or more aiming spots. It is preferable to use different colored fiber optic wave guides for the different aiming spots to facilitate the choice of an appropriate spot for a particular range.

FIG. 1 is a top plan view of a first embodiment of the complete bow sight system of the present invention. Bow stock 10 is shown in cross section (dashed outline) and provides the support for bow mounting plate 12. Clamp screw (horizontal adjustment) 14 tightens the clamp component of bow mounting plate 12 onto clamp (vertical) 16. Likewise, clamp screw (vertical adjustment) 18 tightens the clamp component of clamp (vertical) 16 onto sight stock 20.

Sight stock 20 supports projection stock 22 and integrates fiber optic channel 24 with channel cover plate 26. Fiber optic terminal blocks (four spot version) 28*a*-28*d* incorporate fiber optic adjustment set screws (four spot version) 30*a*-30*d* projection stock 22. Fiber optic wave guides (four spot version) 32*a*-32*d* carry light from the light receptor coil assembly 34 mounted on the coil bracket 36 which is positioned on the sight base assembly 38.

Sight tube (sight ring) 40 integrates and holds reflective objective optic 42 with optic retainer ring 44. The angle of sight tube 40 can be adjusted using sight pivot screw 46 and sight adjustment screw 48.

Figure 2:
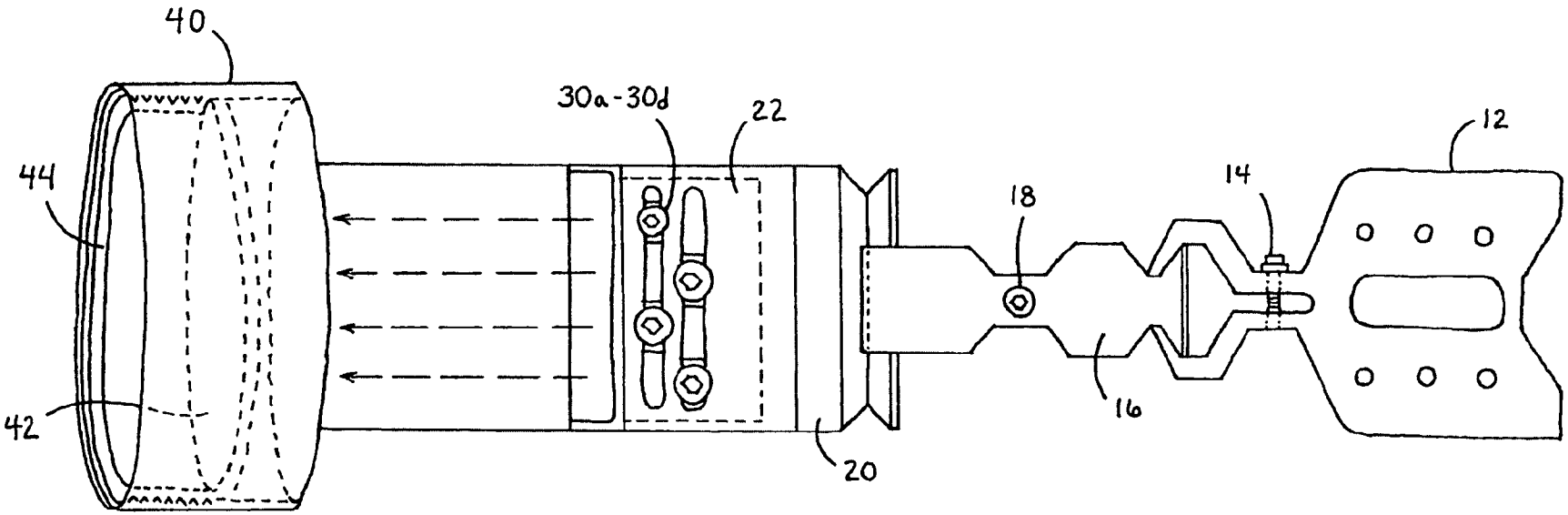
FIG. 2 is a side plan view of the first embodiment of the complete bow sight system of the present invention shown in FIG. 1.

FIG. 2 is a side plan view of the first embodiment of the complete bow sight system of the present invention shown in FIG. 1 with the same referenced components identified therein.

Figure 3:
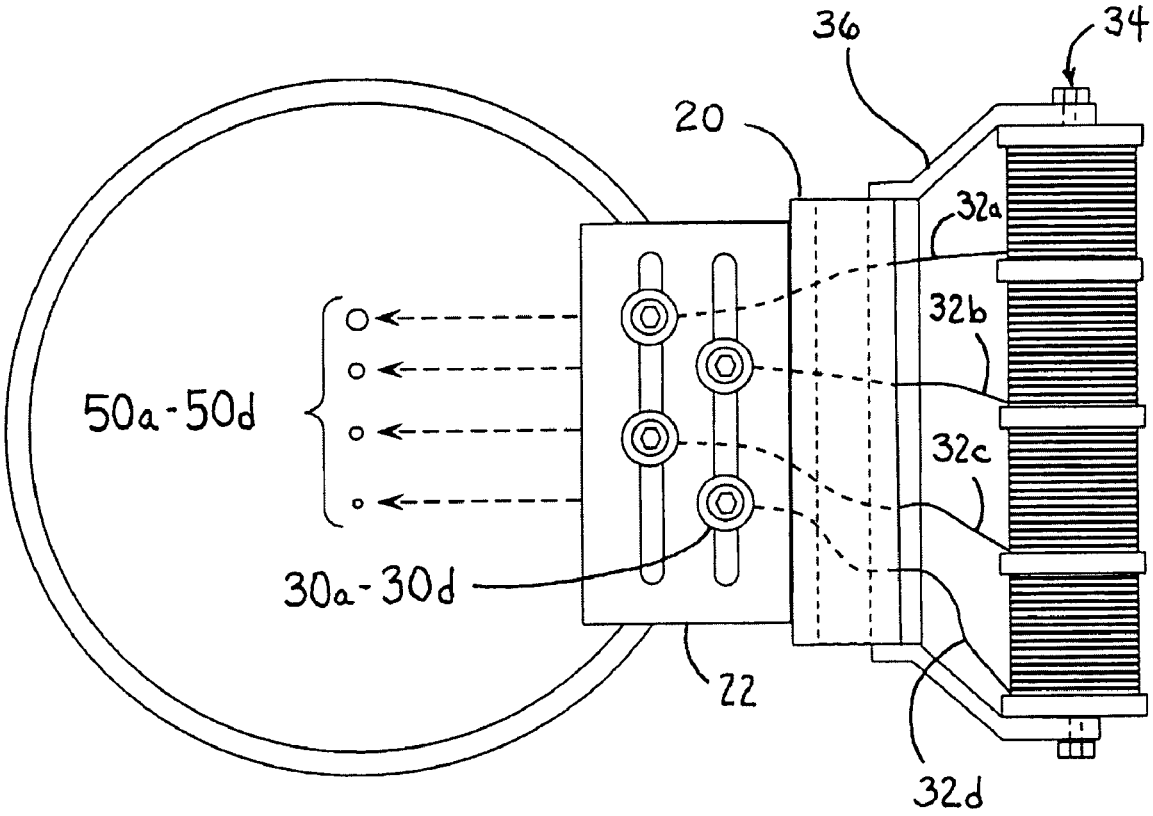
FIG. 3 is an end view of the first embodiment of the bow sight system of the present invention as seen from the point of view of the archer with the mounting plate components removed for clarity.

FIG. 3 is an end view of the first embodiment of the bow sight system of the present invention as seen from the point of view of the archer with the mounting plate components removed for clarity. In this view the aiming spot images 50*a*-50*d* can be seen.

Figure 4C:
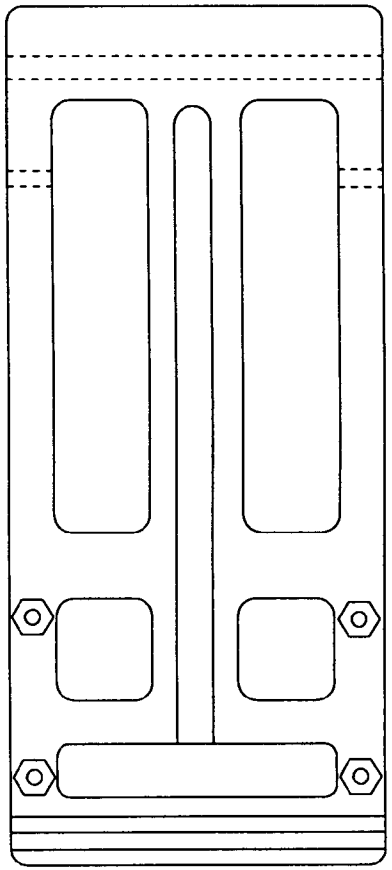
FIGS. 4A through 4C are orthogonal plan views of an alternative embodiment of the bow mounting plate component of the present invention.
Figure 4B:
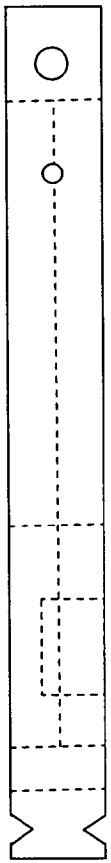
Figure 4A:
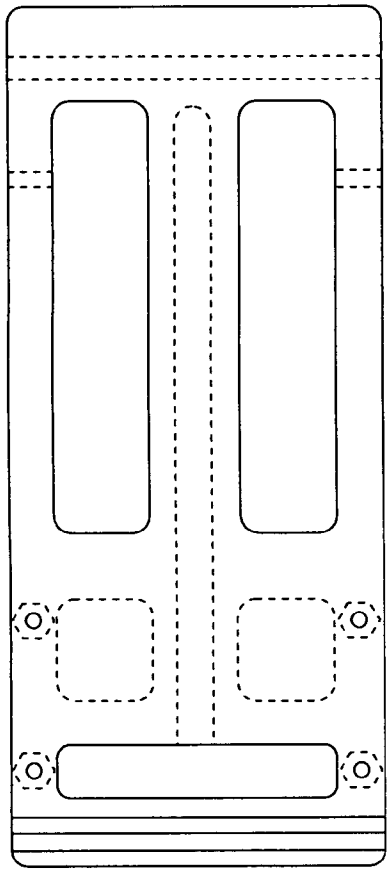

FIGS. 4A through 4C are orthogonal plan views of the sight stock component of the present invention. In this view the manner of attachment of the remaining components (as shown in FIGS. 1 & 2) can be seen.

Figure 5C:
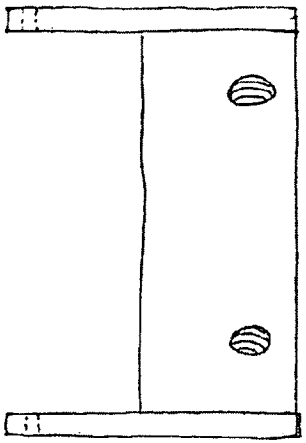
FIGS. 5A through 5C are orthogonal plan views of a bow sight tube bracket of the preferred embodiment of the present invention.
Figure 5B:
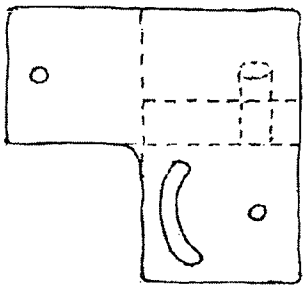
Figure 5A:
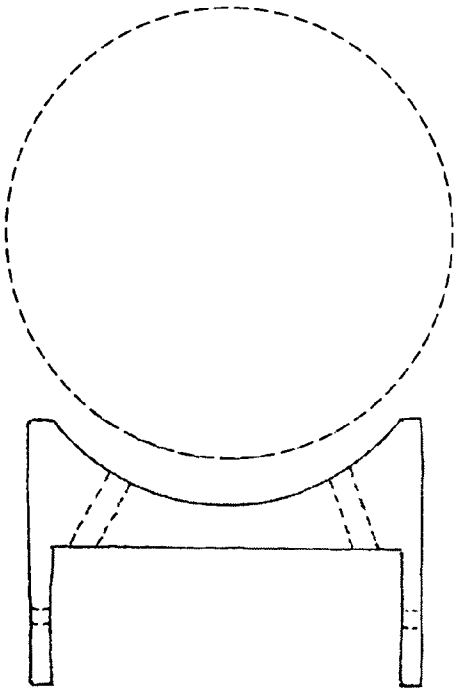

FIGS. 5A through 5C are orthogonal plan views of a bow sight tube bracket of a preferred embodiment of the present invention.

Figure 6A:
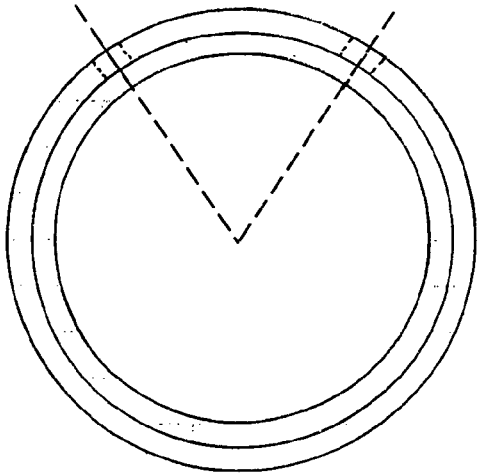
FIGS. 6A and 6B are orthogonal plan views of a bow sight tube ring component of the preferred embodiment of the present invention.
Figure 6B:
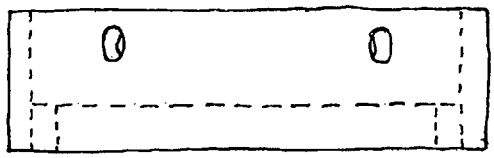

FIGS. 6A and 6B are orthogonal plan views of a bow sight tube ring component of a preferred embodiment of the present invention.

Figure 7A:
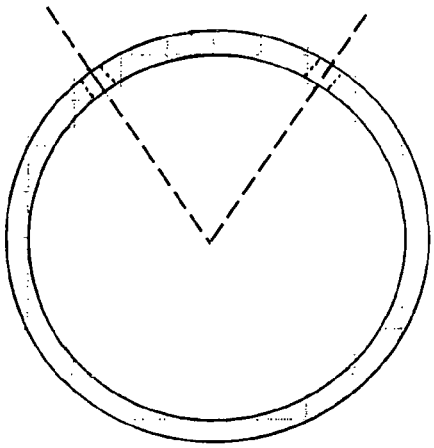
FIGS. 7A and 7B are orthogonal plan views of a retention ring for the sight tube component of the present invention.
Figure 7B:
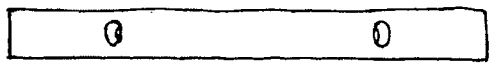

FIGS. 7A and 7B are orthogonal plan views of a retention ring for the sight tube component of the present invention.

Figure 8A:
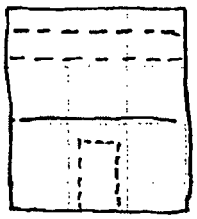
FIGS. 8A through 8C are orthogonal plan views of a fiber optic terminal block structure of the preferred embodiment of the present invention, with FIG. 8B being an assembly view.
Figure 8B:
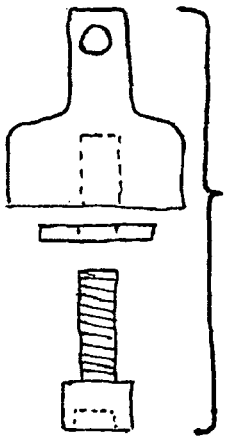
Figure 8C:
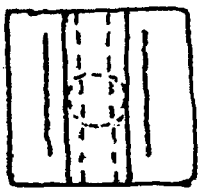

FIGS. 8A through 8C are orthogonal plan views of a fiber optic terminal block structure of the preferred embodiment of the present invention, with FIG. 8B being an assembly view.

Figure 9:
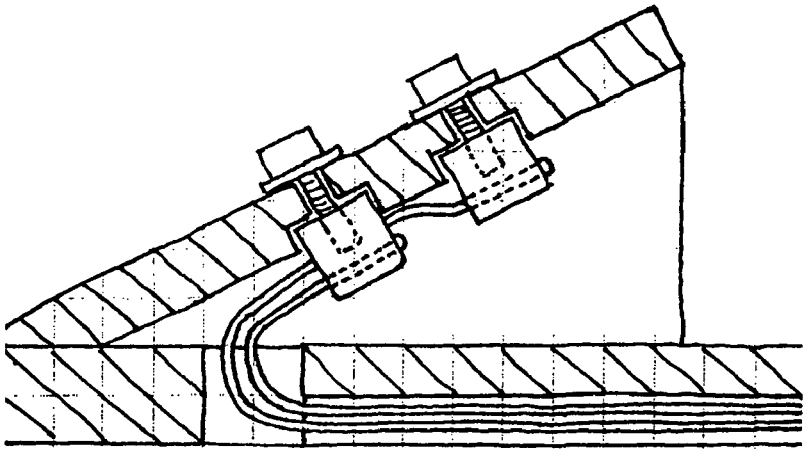
FIG. 9 is a cross-sectional view of a first preferred embodiment of the fiber optic channel and terminal block structure of the present invention.
Figure 10:
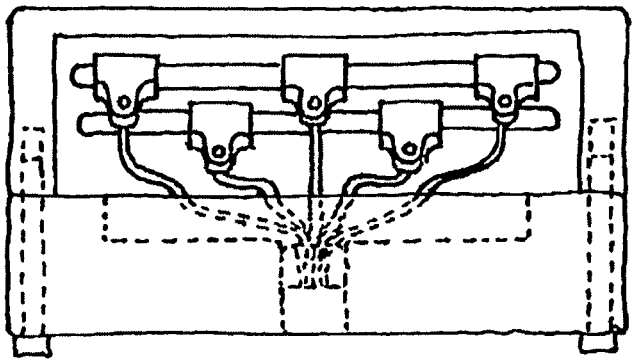
FIG. 10 is a detailed view of a first preferred embodiment of the fiber optic terminal block assembly of the present invention.
Figure 11A:
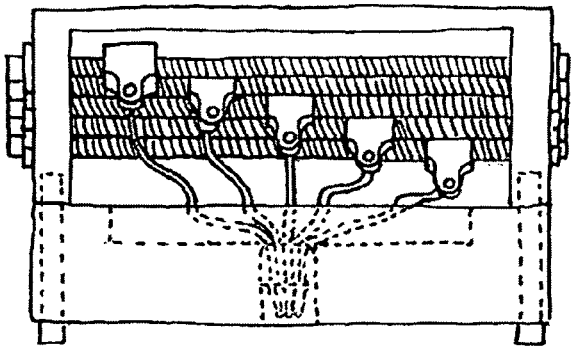
FIGS. 11A and 11B are orthogonal views of an alternate preferred embodiment of the fiber optic terminal block adjustment assembly of the present invention.
Figure 11B:
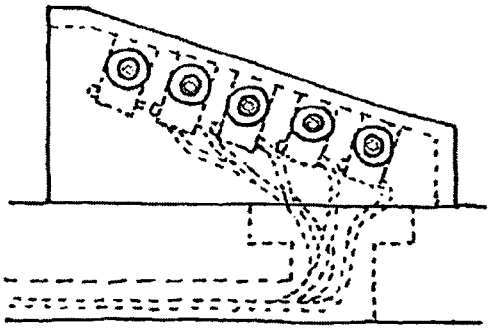
Figure 12A:
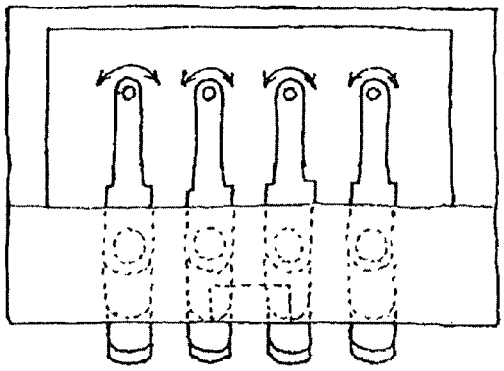
FIGS. 12A and 12B are orthogonal views of a second alternate preferred embodiment of the fiber optic terminal block adjustment assembly of the present invention.
Figure 12B:
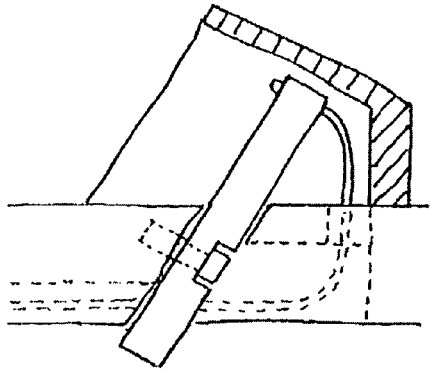
Figure 13A:
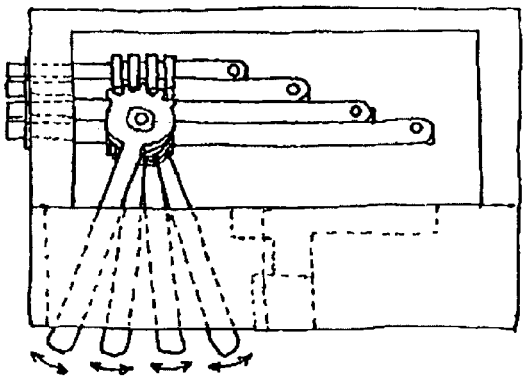
FIGS. 13A and 13B are orthogonal views of a third alternate preferred embodiment of the fiber optic terminal block adjustment assembly of the present invention.
Figure 13B:
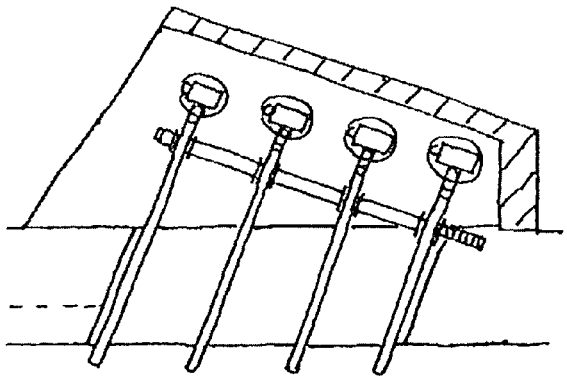

FIG. 9 is a cross-sectional view of a first preferred embodiment of the fiber optic channel and terminal block structure of the present invention.

FIGS. 10, 11A & 11B, 12A & 12B, and 13A & 13B are detailed views of alternate preferred embodiments of the fiber optic terminal block assembly of the present invention.

DETAILED DESCRIPTION OF ALTERNATE PREFERRED EMBODIMENT

Figure 14:
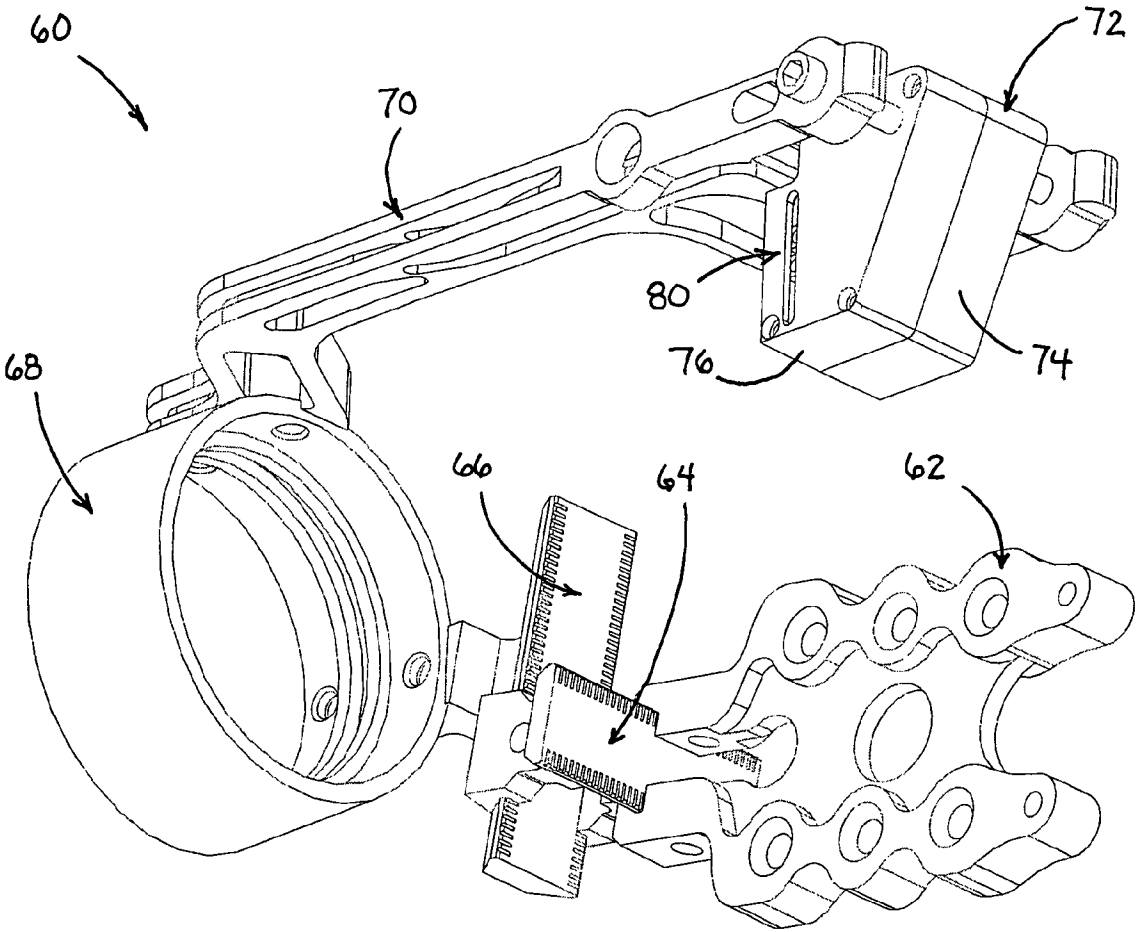
FIG. 14 is a perspective view of an alternative embodiment of the complete bow sight system of the present invention.

FIG. 14 is a perspective view of an alternative embodiment of the complete bow sight system of the present invention. In this view alternate embodiment bow sight system 60 is shown to include bow mounting plate 62, vertical adjustment clamp 64, lens bracket 66, sight tube with optic 68, main beam 70, and fiber optic holder rack 72. Fiber optic holder rack 72 is shown to include right fiber optic holder shell 74 and left fiber optic holder shell 76. Together these components support and position fiber optic holders 80.

Figure 15:
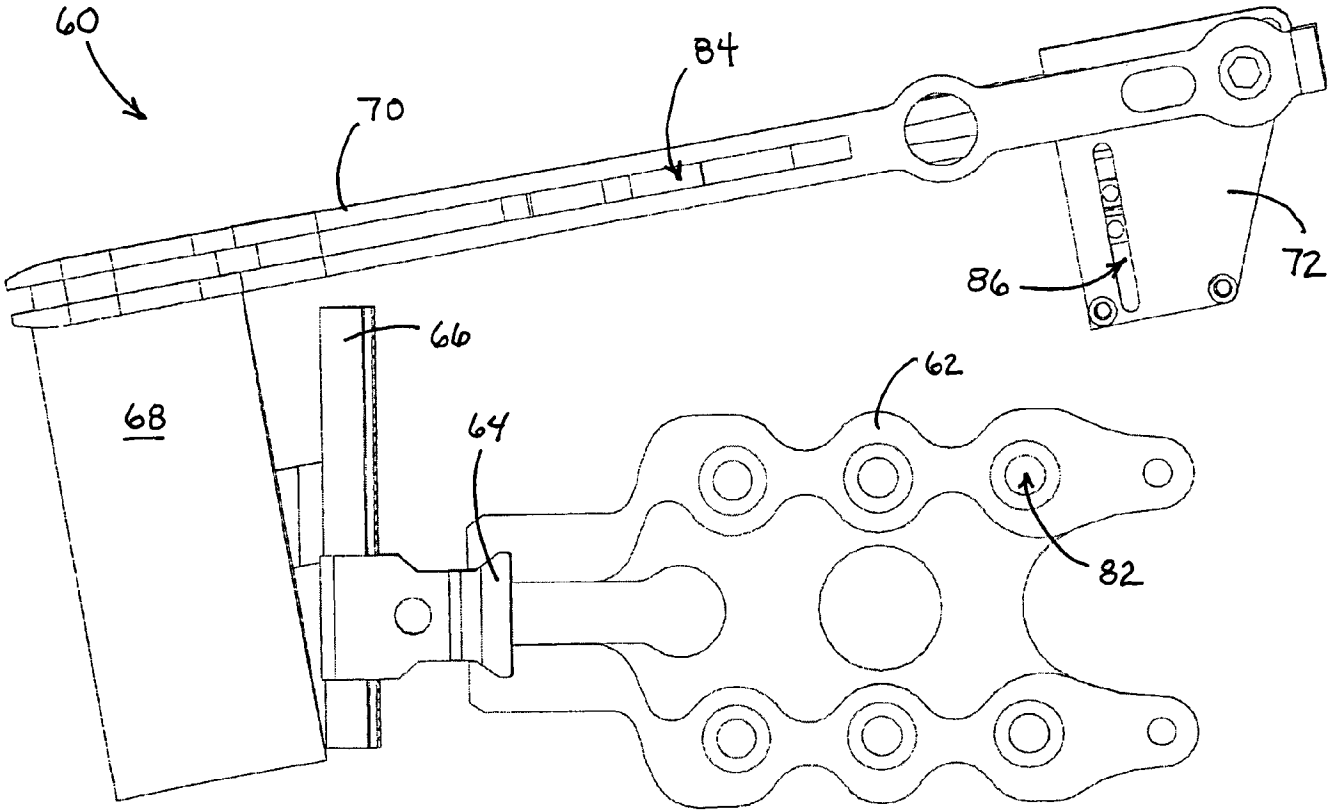
FIG. 15 is an orthogonal side plan view of an alternative embodiment of the complete bow sight system of the present invention.

FIG. 15 is a side plan view of an alternative embodiment of the complete bow sight system of the present invention. In this view mounting holes 82 in bow mounting plate 62 are disclosed. Fiber optic light gathering slots 84 which carry the fiber optics for the system are shown integrated into main beam 70. Fiber optic adjustment window 86 allows the user to view the vertical adjustment of the fiber optic light guides and therefore of the light images in the sight tube.

Figure 16:
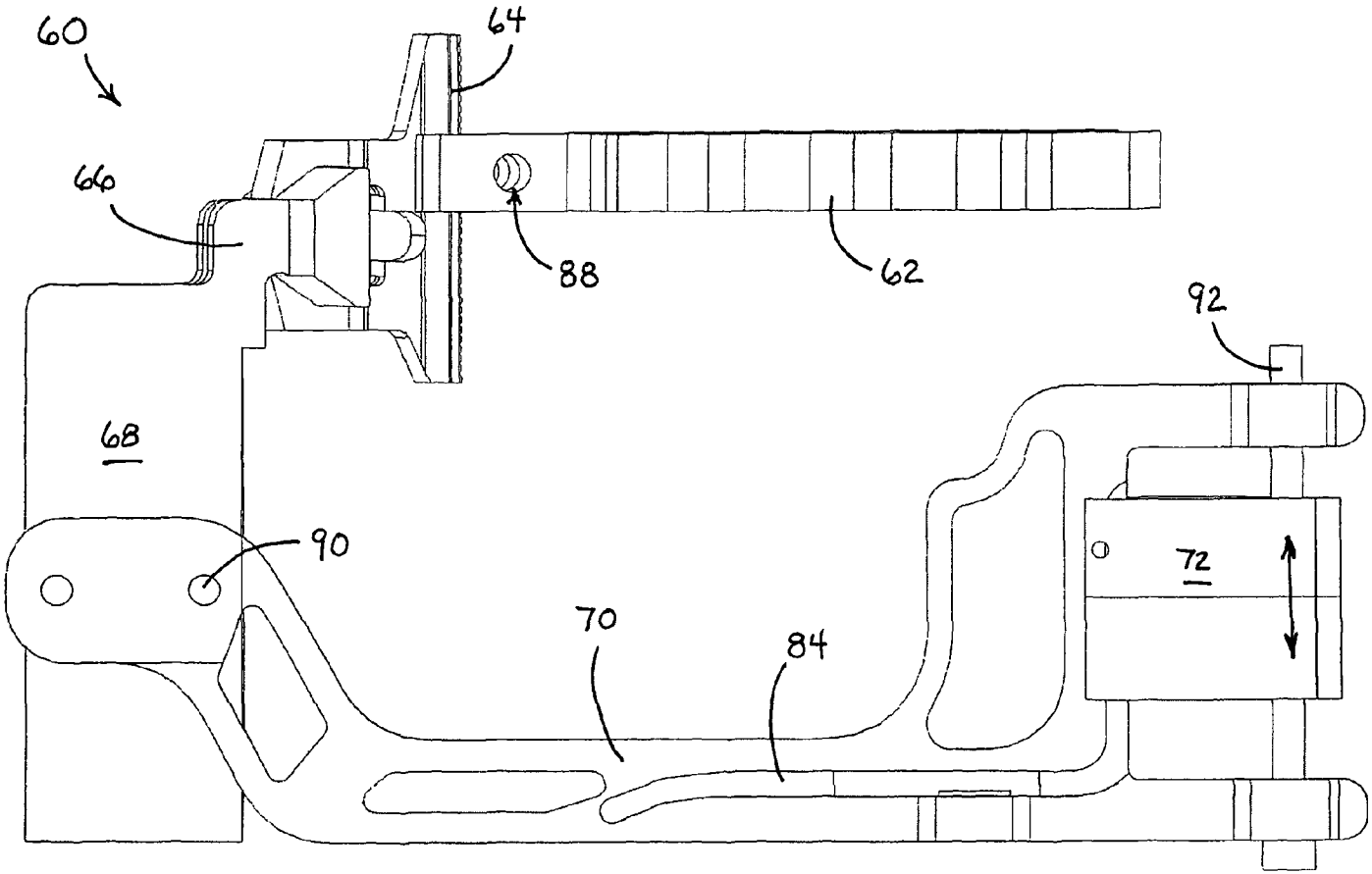
FIG. 16 is an orthogonal top plan view of an alternative embodiment of the complete bow sight system of the present invention.
Figure 17:
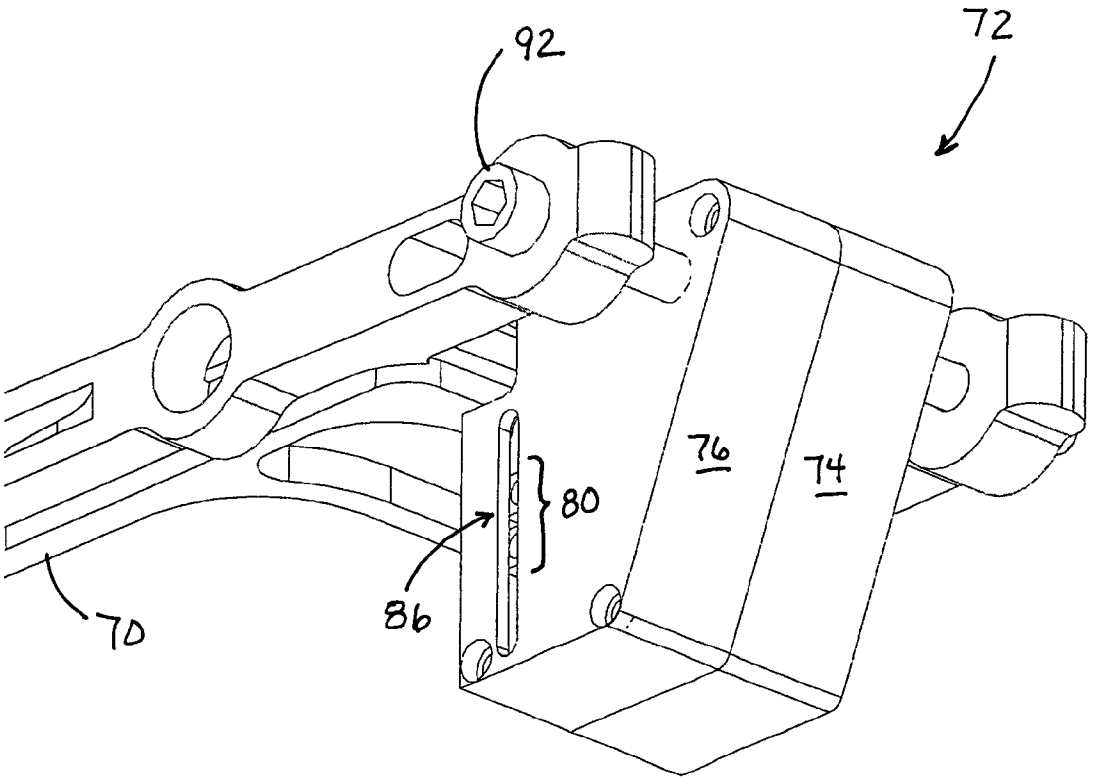
FIG. 17 is a detailed perspective exploded view of the fiber optic housing of an alternative embodiment of the system of the present invention.
Figure 18:
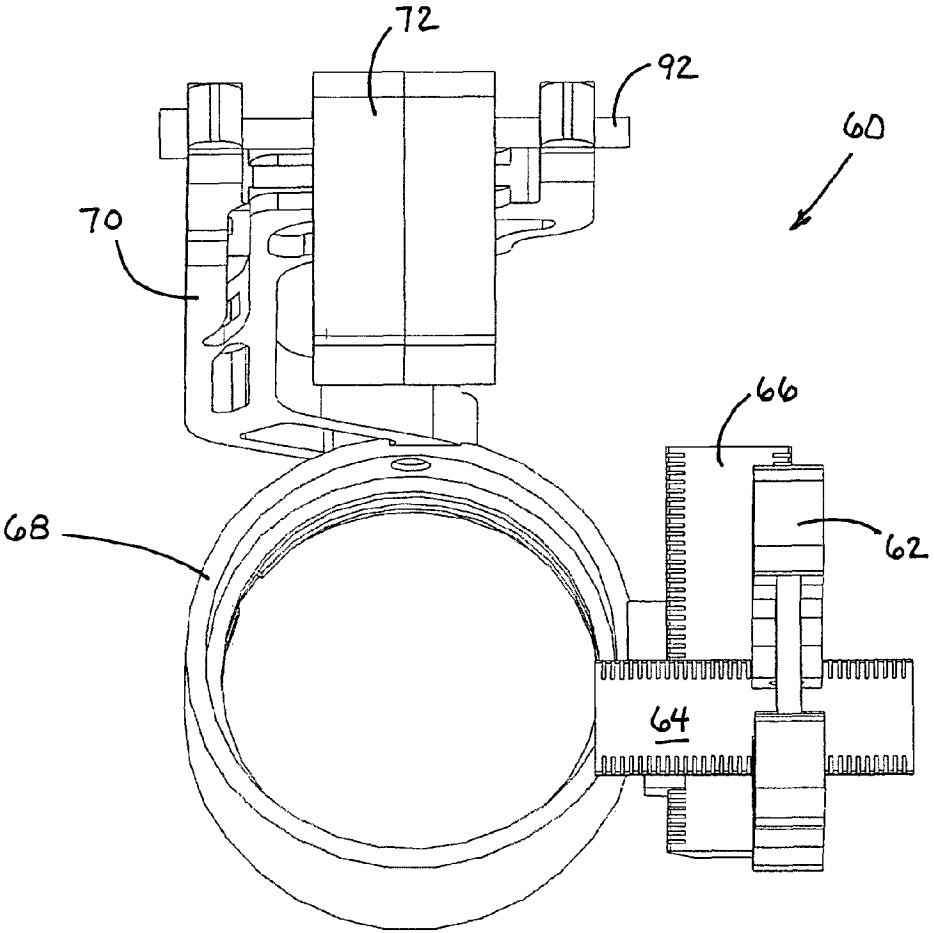
FIG. 18 is an orthogonal rear plan view of an alternative embodiment of the complete bow sight system of the present invention.

FIG. 16 is a top plan view of an alternative embodiment of the complete bow sight system of the present invention. In this view mounting plate clamp tightening screw 88 is shown as the means for clamping bow mounting plate 62 to vertical adjustment clamp 64. Sight tube mounting screw 90 attaches sight tube 68 to main beam 70. Horizontal fiber optic adjustment screw 92 is position to provide a means for moving fiber optic holder rack 72 side to side, thereby adjusting the horizontal position of the light spots on the optics. These components are shown in greater detail in FIGS. 17 & 18.

Figure 19B:
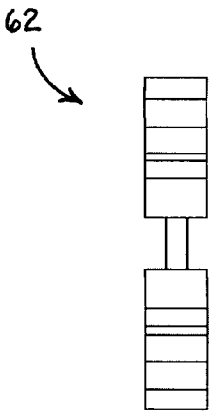
FIGS. 19A through 19C are orthogonal views of the bow mounting plate component of an alternate preferred embodiment of the present invention.
Figure 19A:
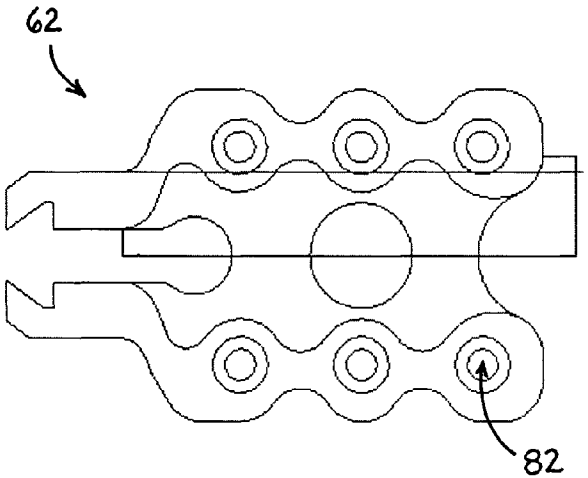
Figure 19C:
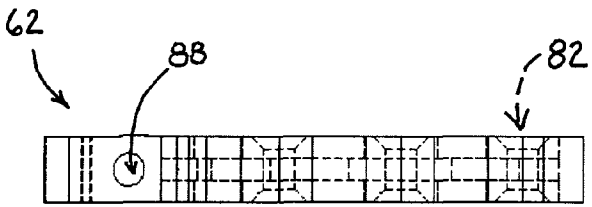

FIGS. 19A through 19C are orthogonal views of the bow mounting plate 62 component of an alternate preferred embodiment of the present invention. Mounting holes 82 are seen clearly in this view.

Figure 20B:
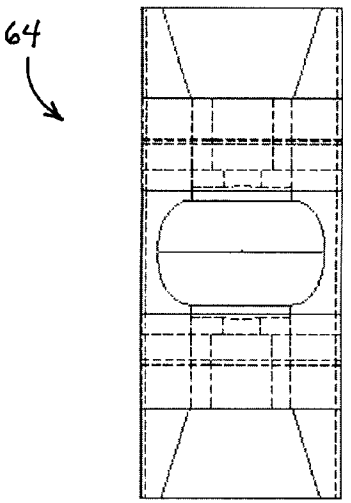
FIGS. 20A through 20C are orthogonal views of the vertical adjustment clamp component of an alternate preferred embodiment of the present invention.
Figure 20A:
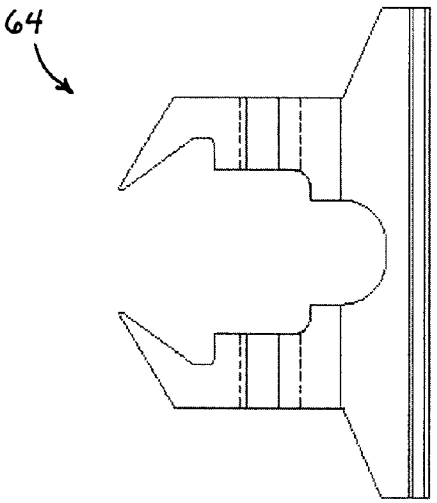
Figure 20C:
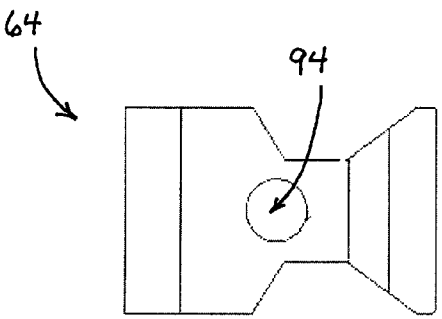

FIGS. 20A-20C are orthogonal views of the vertical adjustment clamp 64 component of an alternate preferred embodiment of the present invention. Vertical adjustment clamp tightening screw 94 is seen in this view.

Figure 21B:
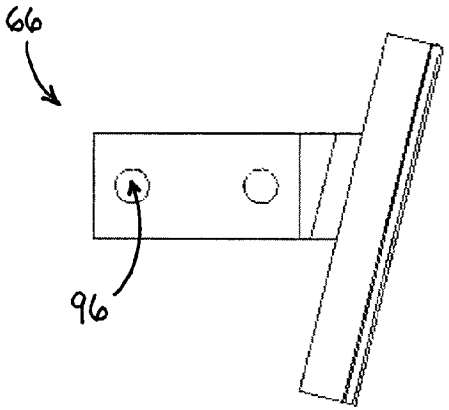
FIGS. 21A through 21C are orthogonal views of the lens bracket component of an alternate preferred embodiment of the present invention.
Figure 21A:
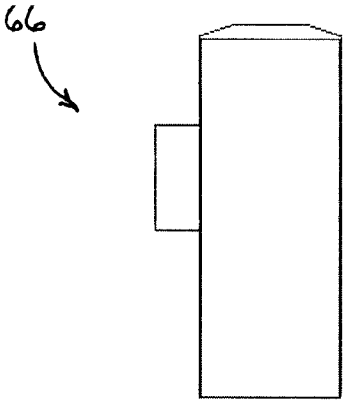
Figure 21C:
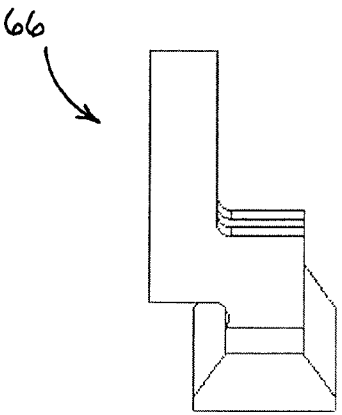

FIGS. 21A-21C are orthogonal views of the lens bracket 66 component of an alternate preferred embodiment of the present invention. Sight tube mounting screws 96 are seen in this view.

Figure 22A:
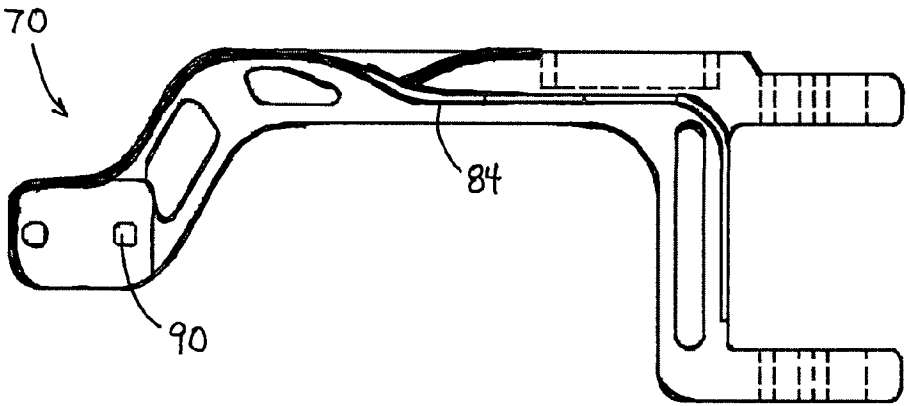
FIGS. 22A through 22C are orthogonal views of the main beam component of an alternate preferred embodiment of the present invention.
Figure 22C:
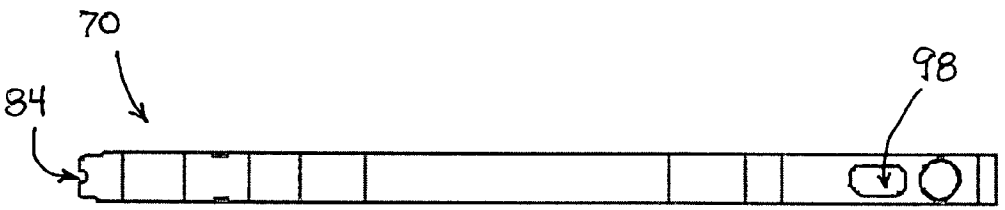
Figure 22B:
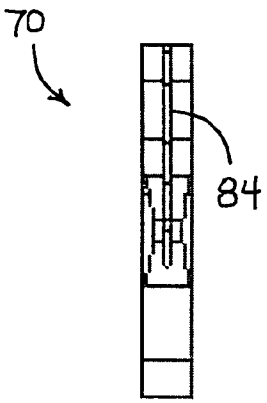

FIGS. 22A-22C are orthogonal views of the main beam 70 component of an alternate preferred embodiment of the present invention. The manner of routing the fiber optic light guides around the sides and edges of the main beam 70, as well as fiber optic passage 98, are shown.

Figure 23C:
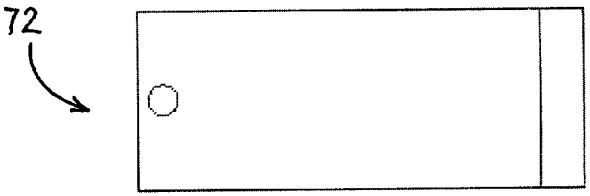
FIGS. 23A through 23C are orthogonal views of the fiber optic holder rack component of an alternate preferred embodiment of the present invention.
Figure 23A:
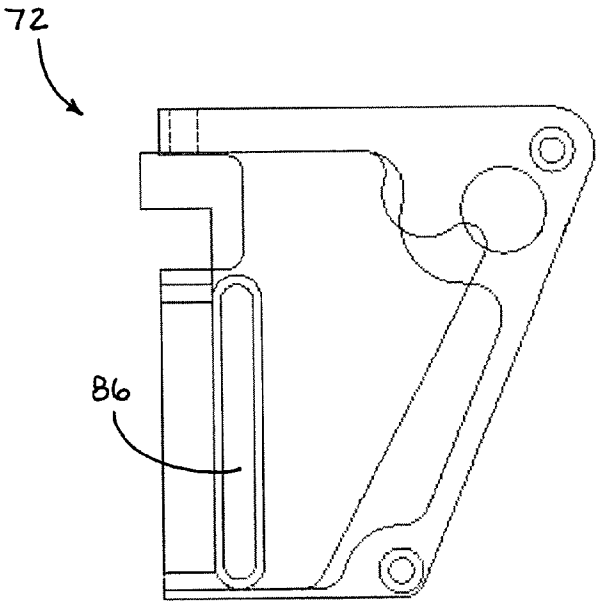
Figure 23B:
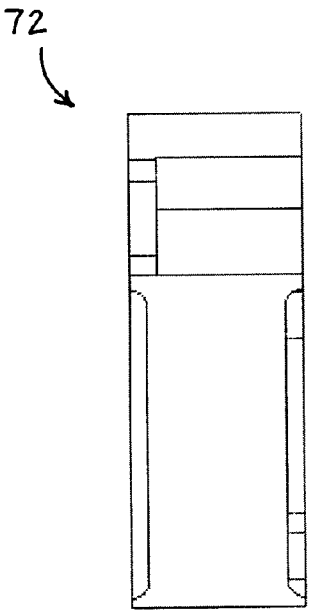
Figure 24C:
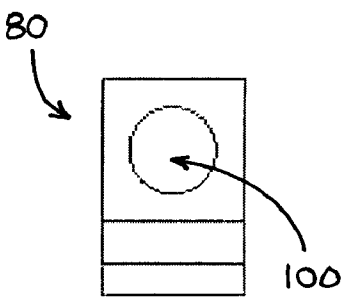
FIGS. 24A through 24D are orthogonal views of a typical fiber optic holder component of an alternate preferred embodiment of the present invention.
Figure 24A:
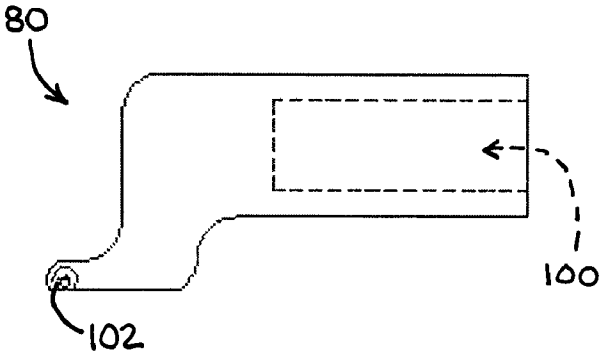
Figure 24D:
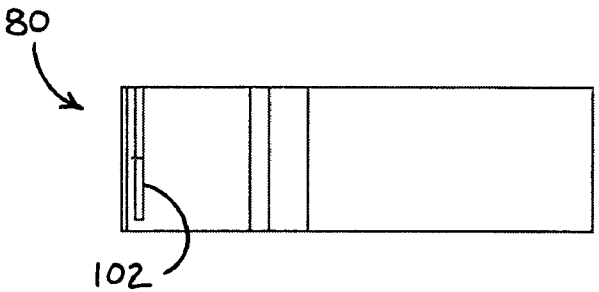
Figure 24B:
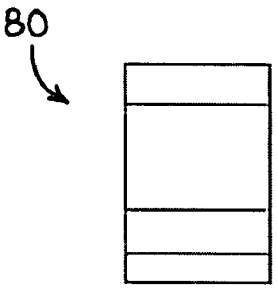

FIGS. 23A-23C are orthogonal views of the fiber optic holder rack 72 component of an alternate preferred embodiment of the present invention.

FIGS. 24A-24D are orthogonal views of a typical fiber optic holder 80 component of an alternate preferred embodiment of the present invention. In this view, fiber optic holder adjustment screw 100 and fiber optic channel aperture 102, as integrated in each of the fiber optic holders 80, are shown.

The changing the configuration from side mounted fibers in the first preferred embodiment to mounting them vertically provides certain additional advantages. When the orientation is vertical with a side configuration, the virtual image generated by the concave lens can sometimes be skewed and as a result may not accurately track the arrow point of impact due to the extreme side angle of reflection. If this is the case, the second preferred embodiment provides an orientation where the fiber holders are located vertically and back in an adjustable housing.

The entire adjustable housing can move side to side with an adjustment screw as described above. This arrangement allows the archer to sight the bow with the overall sight adjustments and then center the dots in the lens with the housing adjustments. Each fiber holder is still individually adjustable vertically, to sight in at the varying distances.

The fiber optic fibers are run out of the housing and through the grove in the main support beam. They are run along the top, side and front of this beam to gather ambient light from all directions. In the preferred embodiment, these fibers are held in clear plastic tubing which may be adhered to the main beam.

The lens in the second preferred embodiment is a concave semi-reflective lens. Depending on availability, a 4-base circular lens with a red semi-reflective coating may be used (the type often used on sunglasses). The fibers must be placed at a specific distance in order to generate the proper virtual image in the lens. This distance is critical to track the point of impact. The light source must be at a precise proportion to the focal length of the lens. The resulting virtual image is greatly magnified and perfectly in line with the point of impact.

Depending on the diameter of the fiber optic fiber the above mentioned magnification can cause some problems. With a fiber of 0.020" the lens magnifies about 3 times and the resulting dot is too big in the view of the archer. The large image is not accurate enough at the longer ranges. One solution is to countersink a 0.023" hole into the holder and then drill out a 0.010" hole for the light to shine through. This cuts the fiber image in half so that it is usable to the archer. This may be a practical approach to reducing the size of the light spot image when necessary.

Although a specific advantage of the present invention is its ability to gather ambient light, it is adaptable for use in conjunction with artificial light sources. The basic system of the present invention may be used in conjunction with standard bow sight mounts that provide horizontal and vertical support adjustments. In addition, the system allows for use on either right or left handed bows by simply inverting the assembly. The system does not interfere with the arrow or the arrow rest in any configuration and generally adds little to the weight of the bow. The various components of the system of the present invention are easily assembled and disassembled as needed for adjustment, maintenance, and/or replacement. The same basic frame, sight tube, and light gathering assembly, may be used with any of the various described fiber optic terminal block assemblies.

The system of the present invention combines the advantages of an ambient light fiber optic bow sight with the advantages of a reflex bow sight. Specifically, the bow sight of the present invention requires no electrical power and collect sufficient ambient light to provide easily visible aiming spots. The system utilizes multiple fiber optic wave guides in order to provide multiple, independently adjustable, aiming spots. The system uses a reflective objective optic to reflect an image of the bright ends of the fiber optics within the field of view. Unlike most systems that utilize fiber optic wave guides, the present invention does not clutter or obstruct the field of view with support structures or other components required by non-reflex systems.

I claim:

1. A bow sight comprising:

(a) a bow mounting plate having a horizontal clamp section;

(b) a clamp bar movably connected to the bow mounting plate, the position of the clamp bar horizontally adjustable within the horizontal clamp section of the bow mounting plate, the clamp bar having a vertical clamp section;

(c) a lens bracket movably connected to the clamp bar, the position of the lens bracket vertically adjustable within the vertical clamp section of the clamp bar;

(d) a sight tube connected to the lens bracket, the sight tube having a partially reflective optical lens positioned in a line of sight for aiming of the bow sight at a target;

(e) a plurality of fiber optic wave guides for collecting ambient light and for projecting at least a portion of the collected ambient light from a terminal end of each fiber optic wave guide;

(f) a fiber optic holder assembly, the terminal ends of the plurality of fiber optic wave guides positioned in generally parallel orientation within the holder assembly, in a direction for projecting the at least a portion of the collected ambient light towards the partially reflective optical lens, the terminal ends of the plurality of fiber optic wave guides independently adjustable in a vertical direction within the holder assembly and collectively adjustable in a horizontal direction with the holder assembly as a whole; and (g) a fiber optic support beam connected to and extending from the sight tube to position and support the fiber optic holder assembly, the plurality of fiber optic wave guides positioned on and extending along the sides and edges of the support beam in a manner as to collect ambient light from multiple directions before terminating within the fiber optic holder assembly.

* * * * *